United States Patent [19]

Hast

[11] 4,084,348

[45] Apr. 18, 1978

[54] SEALING STRIP

[76] Inventor: Gunnar Hast, Eknasvagen 4, 112 64 Stockholm, Sweden

[21] Appl. No.: 782,487

[22] Filed: Mar. 29, 1977

[30] Foreign Application Priority Data

Mar. 29, 1976 Sweden ..... 7603754

[51] Int. Cl.[2] ..... E06B 7/16

[52] U.S. Cl. ..... 49/475; 49/500; 428/71; 428/129

[58] Field of Search ..... 49/485, 475, 500, 496, 49/493; 428/71, 129

[56] References Cited

U.S. PATENT DOCUMENTS

| | | | |
|---|---|---|---|
| 2,686,747 | 8/1954 | Wurtz et al. | 49/475 X |
| 3,041,682 | 7/1962 | Alderfer et al. | 49/475 |
| 3,500,599 | 3/1970 | Sciolino | 49/475 X |

FOREIGN PATENT DOCUMENTS

| | | | |
|---|---|---|---|
| 389,894 | 3/1933 | United Kingdom | 49/493 |
| 486,162 | 5/1938 | United Kingdom | 49/475 |
| 571,165 | 8/1945 | United Kingdom | 49/475 |

*Primary Examiner*—Philip C. Kannan

*Attorney, Agent, or Firm*—Pollock, Vande Sande & Priddy

[57] ABSTRACT

A sealing strip, especially for doors and windows, comprising a porous, resilient core and an outer covering which encloses the core and is circumferentially prolongated to form an elongated mounting flange extending lengthwise along the strip. A gas-proof, flexible foil material is inserted between the core and the covering and is likewise circumferentially prolongated. The foil material and the outer covering are bound to each other only in the region of the mounting flange so as to permit a certain sliding movement between those portions of the foil material and the outer covering, which enclose the core, when the strip is compressed or resiliently expanded.

3 Claims, 2 Drawing Figures

SEALING STRIP

BACKGROUND OF THE INVENTION

The invention relates to a sealing strip, especially for doors or windows, comprising an outer covering, e.g., of textile material, and enclosed therein a resilient core of porous material, such as foamed plastic, textile fibres, foamed rubber or the like, the outer covering being circumferentially prolongated to form an elongated mounting flange extending lengthwise along the strip.

Previously known sealing strips with a porous resilient core, usually of foamed plastic, have, in contrast to strips of extruded solid plastic, a good ability to recover, i.e., to resume their original shape. However, the strips of foamed plastic (with or without an outer covering of textile material) available on the market all have the disadvantage of serving as a soot and dust filter rather than a sealing device. Furthermore, the foamed plastic rapidly deteriorates by the influence of the soot and dust particles being gathered in the pores of the foamed plastic material. Moreover, the foamed plastic material may undergo an aging process caused by exposure to sunlight.

Other known kinds of sealing strips, particularly strips of extruded, solid plastic, do not have the disadvantage of dust and soot collecting pores; on the other hand, they are inclined to collapse rather quickly and to substantially lose their sealing capacity. When a strip has collapsed and become totally dead, it seals unsatisfactorily, since a certain though minor contact pressure is necessary for effective sealing. In addition thereto, windows and doors buckle in the course of time, which likewise contributes to the requirement that the strip have a good ability to resiliently resume its original shape.

SUMMARY OF THE INVENTION

An object of the invention is to remove the above disadvantages and, thus, to provide a sealing strip of the kind referred to in the opening paragraph that, due to a retained resiliency, offers a sealing effect superior to that of previously known sealing strips, and also prevents gathering of soot and dust particles in the porous core.

Another object of the invention is to enable quick and effective mounting of the sealing strip either by self-adhesion or by means of separate fasteners, such as tacks, staples or the like.

These objects are achieved by inserting a gas-proof, flexible foil material between the core and the outer covering, the foil material being likewise circumferentially prolongated and bound to the outer covering only in region of the mounting flange so as to permit a certain sliding movement betwen those portions of the foil material and the outer covering, which enclose the core, when the strip is being compressed or resiliently expanded.

BRIEF DESCRIPTION OF THE DRAWING

The invention will be described more fully below with reference to the drawing, which illustrates an exemplary embodiment of the sealing strip according to the invention.

DESCRIPTION OF AN EXEMPLARY EMBODIMENT

Figure 1:
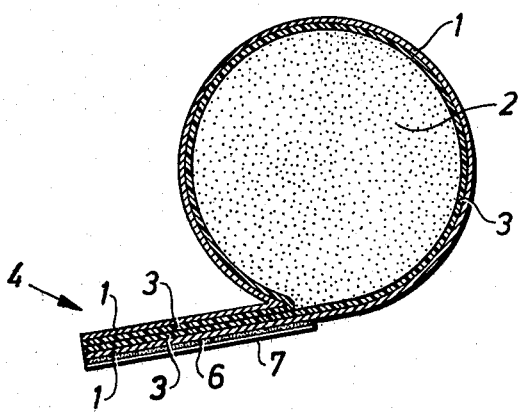
FIGS. 1 and 2 are sectional views of the strip in its free and mounted states, respectively.

The sealing strip shown on the drawing essentially consists of an outer covering 1 of textile fabric, a porous, resilient core 2 of foamed plastic and, in accordance with the invention, a foil 3 of air-proof material, e.g., a synthetic resin, such as PVC or polyethylene, inserted between the outer covering and the core.

Figure 2:
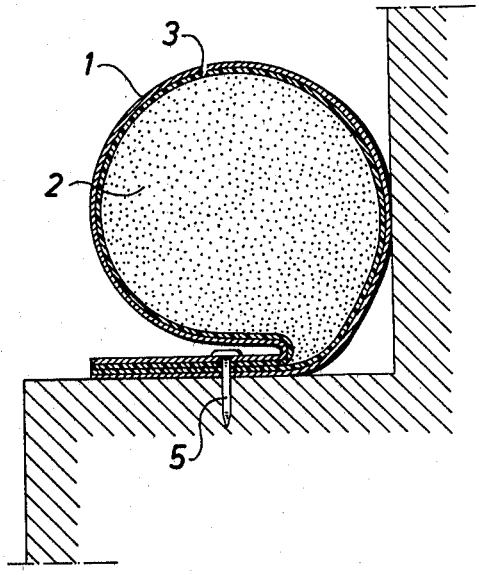

Thus, the outer covering 1 and the foil 3 enclose the core 2 entirely and are prolongated from the joining line and joined into a mounting flange 4 extending longitudinally along the strip. In its free state (FIG. 1), the flange 4 may be somewhat inclined in relation to the tangential direction of the circular section in order to facilitate the mounting of the strip (in particular by means of tacks, staples or the like), e.g., along the edge of inner corner of a door or window or the frame thereof (FIG. 2). When making the strip, the outer covering 1 and foil 3 are preferably joined into a double strip by gluing or welding the edge portions together. Upon enclosure around the core 2, these edge portions of the double strip are glued or welded together to form the mounting flange 4. The flange may either be applied directly to the door, the window or the frame by suitable fasteners, such as tacks 5 (FIG. 2) or staples, or a double-adhesive strip 6 (FIG. 1) may be applied to the flange, so that upon removal of a protective paper strip 7 the sealing strip can be applied adhesively without any auxiliary means.

The use of foamed plastic as the core material has the advantage that it is inexpensive and, since it is protected from light (if the foil 3 is not transparent) and impurities, it is also long lasting. However, only foamed plastic of low weight per volume has good resiliency. When expanding resiliently, the foamed plastic exerts only a minor spring force and it is therefore very important for the restoring capacity of the strip (even after long use) that the foil 3 and the outer covering 1 create as little resistance as possible, when the strip shall expand itself. Thus, it is essential that the outer covering 1 and the foil 3 be bound together only in the region of the mounting flange 4 and that those portions, which enclose the core 2, permit a certain relative sliding movement in order to follow the expansion of the core. If, however, the foil 3 and the outer covering 1 were bound together by means of, e.g., an adhesive, or by welding, they would form a fairly rigid closure and would prevent the expansion of the core 1. In such case, the inherent resiliency of the formed plastic would not be utilized, and the closure itself would determine the resiliency of the strip.

Moreover, the outer covering 1 as well as the foil 3 are preferably as thin as possible, partly for keeping down the weight, partly for reducing the stiffness. The foil, which may be made of PVC or polyethylene, preferably has a thickness of 0.05 – 0.08 mm and is preferably black or dark colored, so as to protect the foamed plastic from light.

The substantially circular section of the sealing strip, as shown in the drawing, can be obtained in practice from a foamed plastic core of essentially square section which is enclosed by the plastic foil 3 with a certain stretch, so that the material adopts a circular section. However, the sectional shape of the sealing strip is not critical to the invention. Consequently, the sealing strip may have a square, a rectangular or some other regular or irregular form. Also, it may be advantageous to use a square or rectangular core which is enclosed by the foil material 3 and the outer covering 1 rather loosely, so that the friction between the core and the foil material does not affect the resiliency of the strip.

The inventive sealing strip has proved to possess extremely good sealing qualities, even after years of use. Moreover, the strip is light non-elastic in the longitudinal direction and inexpensive to manufacture.

I claim:

1. A sealing strip for doors, windows and the like, comprising, in combination (a) an elongated, resilient, porous core of a synthetic foam material;

(b) a flexible covering enclosing said core and consisting of an outer layer of textile material an an inner layer of a gas-proof, flexible foil material;

(c) said outer and inner layers both being prolongated circumferentially so as to jointly form an elongated mounting flange and being bound together only in the region of said mounting flange;

(d) the thickness of the outer and inner layers being dimensioned so as to permit resilient expansion of the core without substantial resistance from said layers while permitting sliding movement between those portions of said layers which enclose the core.

2. A sealing strip according to claim 1, wherein the foil material is dark colored so as to protect the core from sunlight.

3. A sealing strip according to claim 1, wherein the thickness of said inner layer is 0.05 to 0.08 mm.

* * * * *